US008097824B2

(12) United States Patent
Kil

(10) Patent No.: US 8,097,824 B2
(45) Date of Patent: Jan. 17, 2012

(54) ARC EXTINGUISHING DEVICE OF CIRCUIT BREAKER FOR MANUAL MOTOR STARTER

(75) Inventor: Hwan Chang Kil, Chungcheongbuk-do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 724 days.

(21) Appl. No.: 12/200,227

(22) Filed: Aug. 28, 2008

(65) Prior Publication Data

US 2009/0057273 A1 Mar. 5, 2009

(30) Foreign Application Priority Data

Sep. 3, 2007 (KR) ..... 10-2007-0088880

(51) Int. Cl.
*H01H 33/02* (2006.01)

(52) U.S. Cl. ..... 218/149; 218/156

(58) Field of Classification Search ..... 218/34–41, 218/147–151, 156–158; 335/16, 201, 202
See application file for complete search history.

(56) References Cited

U.S. PATENT DOCUMENTS 6,794,595 B2 * 9/2004 Charles et al. ..... 218/149

* cited by examiner

*Primary Examiner* — Renee Luebke
*Assistant Examiner* — Marina Fishman
(74) *Attorney, Agent, or Firm* — Lee, Hong, Degerman, Kang & Waimey

(57) ABSTRACT

Disclosed is an arc extinguishing device of circuit breaker for manual motor starter capable of swiftly extinguishing and discharging an arc generated by a fault current flowing into a motor circuit during an interruption operation of a circuit breaker, thereby enhancing the performance of interruption.

2 Claims, 5 Drawing Sheets

ARC EXTINGUISHING DEVICE OF CIRCUIT BREAKER FOR MANUAL MOTOR STARTER

CROSS-REFERENCE TO RELATED APPLICATIONS

Pursuant to 35 U.S.C. §119(a), this application claims the benefit of earlier filing date and right of priority to Korean Application No. 10-2007-0088880, filed on Sep. 3, 2007, the contents of which are hereby incorporated by reference herein in its entirety.

TECHNICAL FIELD

The following description relates generally to a circuit breaker for manual motor starter, and more particularly to an arc extinguishing device of circuit breaker for manual motor starter capable of swiftly extinguishing and discharging an arc generated by a fault current flowing into a motor circuit during an interruption operation of a circuit breaker, thereby enhancing the performance of interruption.

BACKGROUND ART

In general, a manual motor starter (so called MMS as abbreviated) serves as a switching device which has a function for protecting a motor by interrupting power supply to the motor upon generation of a fault current in a section for starting or stopping the motor, such as an electric shortage, a ground fault and an electric phase deficiency.

FIG. 1 is a schematic cross-sectional view of a conventional manual motor starter to which an arc extinguishing device is applied.

A conventional circuit breaker (1) for manual motor starter (hereinafter referred to as MMS) largely has a structure in which an upper frame (3) and a lower frame (5) are coupled. A detector (10) usually detects a failure current inputted from a power source terminal (12). An open/close mechanism (20) opens and closes the circuit breaker (1) in response to a detection signal from the detector (10). The open/close operation of the circuit breaker is implemented in such a manner that a movable contact (36) of a movable contact bar (35) is separated from a stationary contact (33) of a stationary contact bar (32) by the operation of the open/close mechanism (20) to prevent a failure current from flowing to a load, i.e., a motor via a motor-side terminal (14), thereby protecting the motor.

A high pressure and high temperature arc is generated between the movable and stationary contacts (33, 36) when the movable contact (36) of the movable contact bar (35) is separated from the stationary contact (33) of the stationary contact bar (32). Unless the arc is swiftly extinguished and discharged outside, the movable and stationary contacts (33, 36) may be damaged by the high pressure and high temperature arc, and in worst case, the arc may result in failure of interruption of the fault current which in turn damages the product. Therefore, it is essential that the arc be swiftly extinguished and discharged outside of the circuit breaker (1)

Now, structure and operation of a conventional arc extinguishing device (40) in the circuit breaker (1) will be described in greater detail with reference to FIGS. 2, 3, 4 and 5.

Referring to FIG. 2, an arc chamber (50) of a conventional arc extinguishing device (40) includes a plurality of magnetic plates (52) and a side wall (54) in which the plurality of magnetic plates (52) are packaged. Each magnetic plate (52) may have a U-shaped member opened in the direction of arc generation, and induce the arc (a) in response to the electromagnetic force.

When a fault current is introduced, the movable contact (36) is separated from the stationary contact (33) by the open/close mechanism (20) of FIG. 1 to generate a high pressure and high temperature arc. Although the movable and stationary contacts (33, 36) are discrete, a phenomenon of a current flowing by the arc (a) is generated, such that the fault current is not completely interrupted. The arc (a) is induced into the arc chamber (50) by the electromagnetic force of the plurality of magnetic plates (52). At this time, the arc (a) is further sped up in movement along the conductive stationary contact bar (32) and a lower plate (60). In the course of this process, the arc (a) is extinguished by cathode effect and cooling effect of the magnetic plates (52) to finally interrupt the flow of the fault current and is discharged via an arc outlet (55) formed at the side wall (54).

However, because the short-circuit current introduced in the circuit breaker for MMS is large in most cases, a strong arc is generated and induced between the movable and stationary contacts (33, 36). As a result, the arc (a) generated from within the arc chamber (50) is not completely extinguished to generate a residual arc (b) connecting a distal end of the stationary contact bar (32) and a distal end of the lower plate (60). The residual arc (b) allows the fault current to flow, thereby resulting in a problem of delaying the interruption time.

Another problem is that distal ends of the stationary contact bar (32) and the lower plate (60) are melted down due to the residual arc (b) generated from the distal ends of the stationary contact bar (32) and the lower plate (60), or generates a thermal deformation bending toward the magnetic plate. The thermal deformation markedly degrades the performance of arc extinguishment, thereby leading to decrease of short-circuit interruption capacity of the circuit breaker.

In order to alleviate the problems caused by the residual arc (b), an arc extinguishing device (40') is disclosed in the European Patent Registration No. 1,032,942.

FIG. 4 is a schematic perspective view of an arc chamber (50') that has improved the conventional arc extinguishing device. The arc extinguishing device (40') of FIG. 4 is distinguished from the arc chamber (50) of FIG. 2 in that an extension (56) protruded to an upper surface of the side wall (54) disposed with an arc outlet (55) is formed at the improved arc chamber (50').

Referring to FIG. 5, the extension (56) of the improved arc chamber (50') is made of insulation material as that of the side wall (54), and is extended to abut on a distal end of the stationary contact bar (32). As a result, the arc (a) generated between the distal end of the stationary contact bar (32) and the distal end of the lower plate (60) can be interrupted.

However, the conventional improved arc chamber (50') suffers from disadvantages in that the extension (56) has a protrusive shape that tends to be deformed in the course of manufacturing or transportation of the arc chamber (50'), thereby disabling to interrupt the arc generated between the distal end of the stationary contact bar (32) and that of the lower plate (60). Another disadvantage of the conventional improved arc chamber (50') is that the arc chamber (50') may be manufactured upside down due to a mistake by assembling workers. In other words, the extension (56) may be positioned at the lower plate (60) to disable to interrupt the arc (a) generated between the distal end of the stationary contact bar (32) and that of the lower plate (60).

TECHNICAL SOLUTION

Therefore, the present disclosure has been made in view of the above-mentioned problems, and an object of the present disclosure is to provide an arc extinguishing device of circuit breaker for manual motor starter capable of swiftly extinguishing and discharging an arc generated by a fault current flowing into a motor circuit during an interruption operation of a circuit breaker, thereby enhancing the performance of interruption, and preventing the circuit breaker and the motor from being damaged.

Another object is to provide an arc extinguishing device of circuit breaker for manual motor starter capable of preventing thermal deformation caused by high temperature and high pressure and to increase a short-circuit interruption capacity, thereby improving the arc distinguishing performance.

Still another object is to provide an arc extinguishing device of circuit breaker for manual motor starter capable of prevent a loss of arc interruption performance caused by upside-down assembly of an arc chamber.

The foregoing and/or other aspects of the present general inventive concept are achieved by providing an arc extinguishing device of circuit breaker for manual motor starter, the device formed with a detector detecting a fault current, an open/close mechanism operating in response to a detection signal of the detector, power source side and motor side stationary contact bars having stationary contacts, and movable contact bars having movable contacts each discrete from the stationary contacts by operation of the open/close mechanism, the device characterized by: an arc chamber composed of a plurality of magnetic plates and a side wall packaging the plurality of magnetic plates for inducing and extinguishing an arc generated when the stationary contacts and the movable contacts are separated; a lower plate made of conductive material for supporting a lower end of the side wall; and an insulation member coupled to distal ends of the power source side and motor side stationary contact bars for interrupting the arc generated between the distal ends of the power source side and motor side stationary contact bars and the distal end of the lower plate.

Implementations of this aspect may include one or more of the following features.

The power source stationary contact bar may have a U-shaped member, and the insulation member may include a main plate inserted into a 'U' shaped gap of the power source side stationary contact bar, and a projection protrusively formed from a bottom surface of the main plate to abut on a distal end of the power source side stationary contact bar so as to allow the distal end of the power source side stationary contact bar to be blocked from outside.

The insulation member may be insertedly coupled to allow the distal end of motor side stationary contact bar to be blocked from outside.

The insulation member may have a '⊏' shaped horizontal cross-section surface and be insertedly coupled to the distal end of motor side stationary contact bar.

The distal end of motor side stationary contact bar may be laterally formed with a groove, and the insulation member may be formed at an inner lateral surface thereof with a projection so as to be insertedly coupled to a slit groove of the motor side stationary contact bar.

ADVANTAGEOUS EFFECTS

An arc extinguishing device of circuit breaker for manual motor starter is capable of preventing a residual arc generated between a distal end of a stationary contact bar and that of a lower plate to reduce an interruption time, thereby protecting a circuit breaker and a motor from being damaged by a fault current.

A thermal deformation of distal ends of stationary contact bars and a distal end of the lower plate by the residual current can be prevented to improve the arc extinguishing performance and to increase a short-circuit interruption capacity of the circuit breaker. The residual current can be removed by blocking the distal ends of the stationary contact bars from outside using easy fitting or insertion method.

Damage of an extension of the conventional arc chamber during transportation can be prevented, or loss of arc interruption performance caused by upside-down assembly of an arc chamber formed with an extension can be prevented.

BEST MODE

Exemplary implementations of an arc extinguishing device of circuit breaker for manual motor starter according to the present novel concept will be described in detail with reference to the accompanying drawings.

Figure 1:
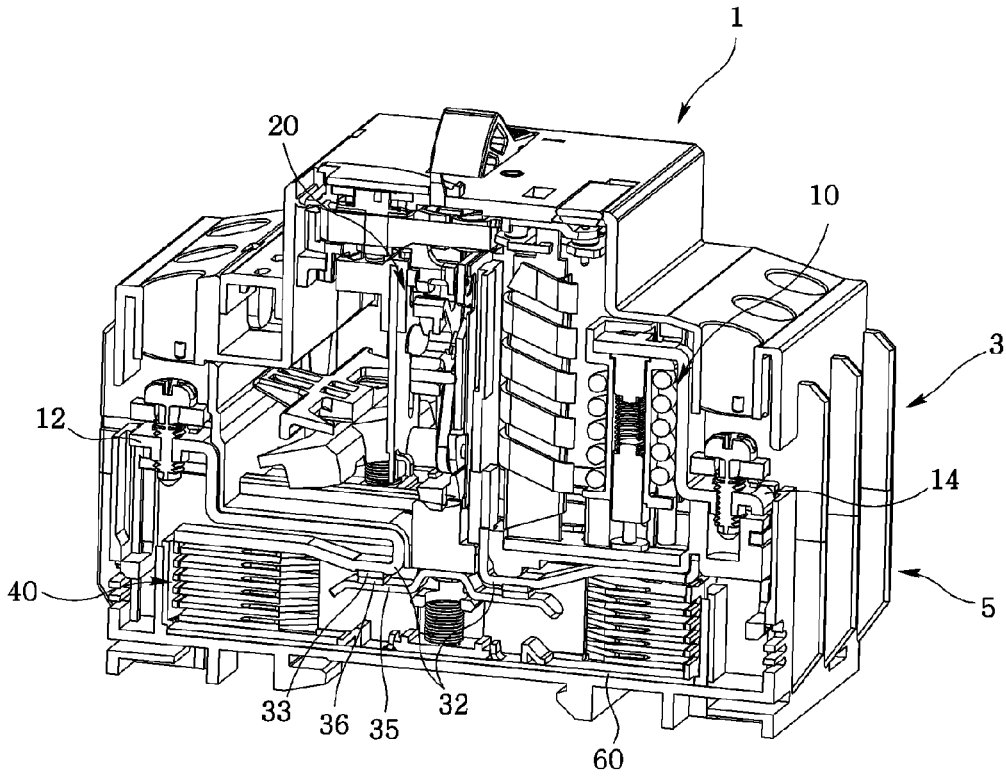
FIG. 1 (PRIOR ART)
FIG. 1 is a schematic cross-sectional view of a conventional manual motor starter to which an arc extinguishing device is applied.
Figure 2:
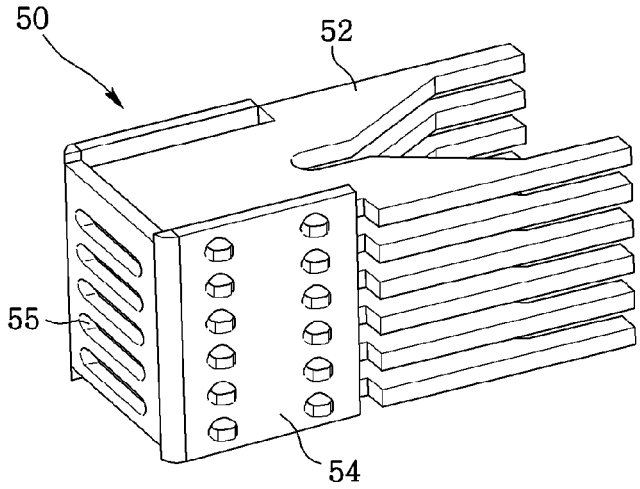
FIG. 2 (PRIOR ART)
FIG. 2 is a schematic perspective view of an arc chamber at the arc extinguishing device of FIG. 1.
Figure 3:
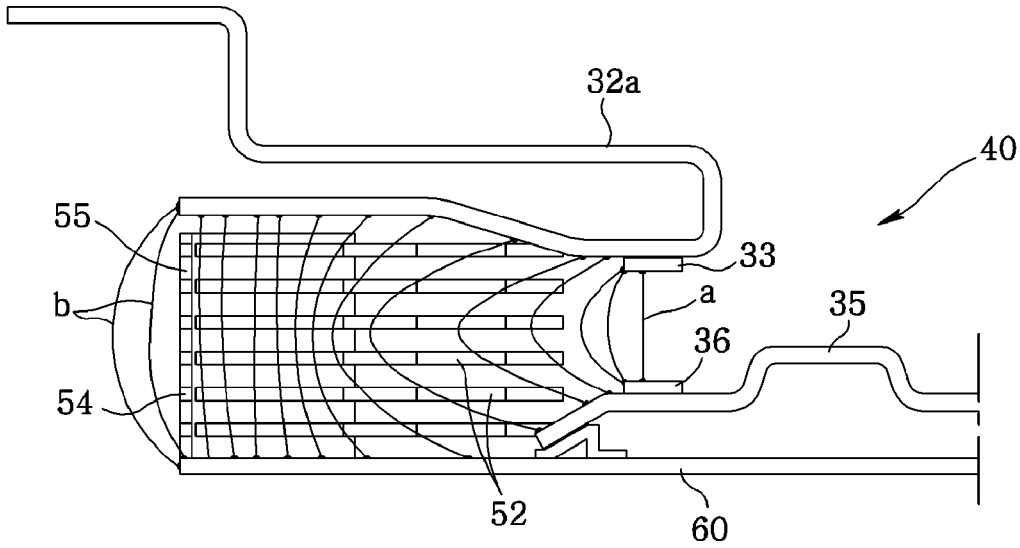
FIG. 3 (PRIOR ART)
FIG. 3 is a schematic view explaining an arc extinguishing operation of the arc extinguishing device of FIG. 1.
Figure 4:
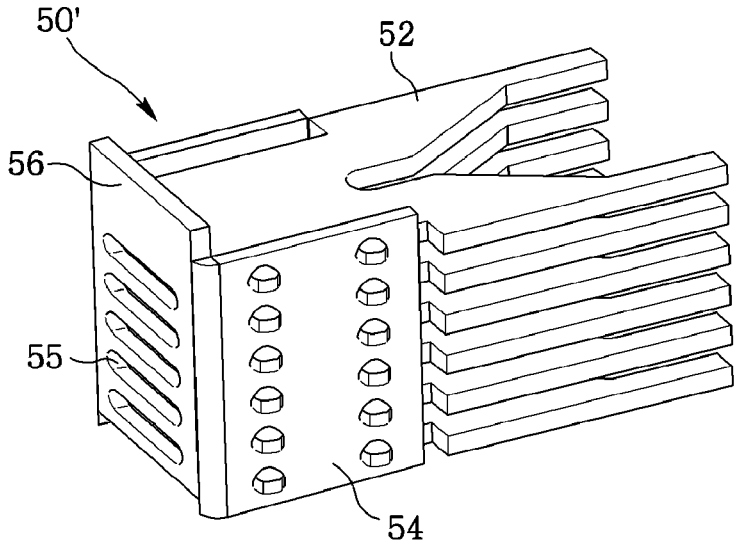
FIG. 4 (PRIOR ART)
FIG. 4 is a schematic perspective view illustrating an improved arc chamber of a conventional arc extinguishing device.
Figure 5:
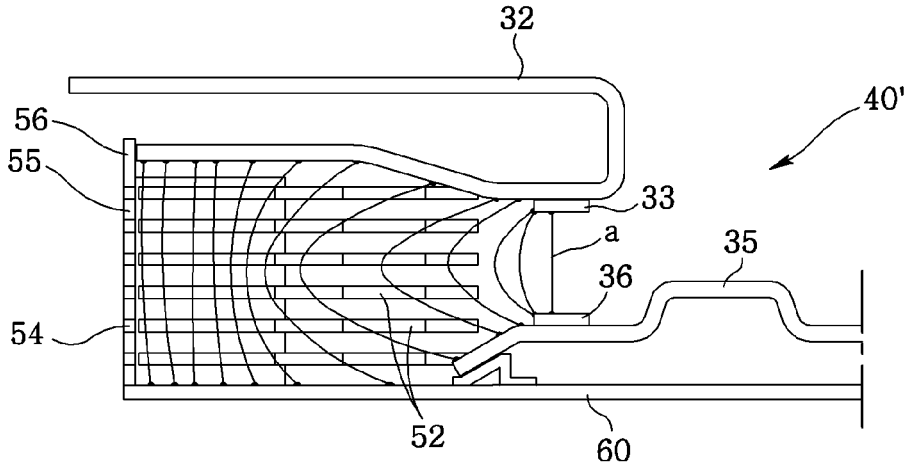
FIG. 5 (PRIOR ART)
FIG. 5 is a schematic view explaining an arc extinguishing operation of the arc extinguishing device to which the improved arc chamber of FIG. 4 is applied.
Figure 6:
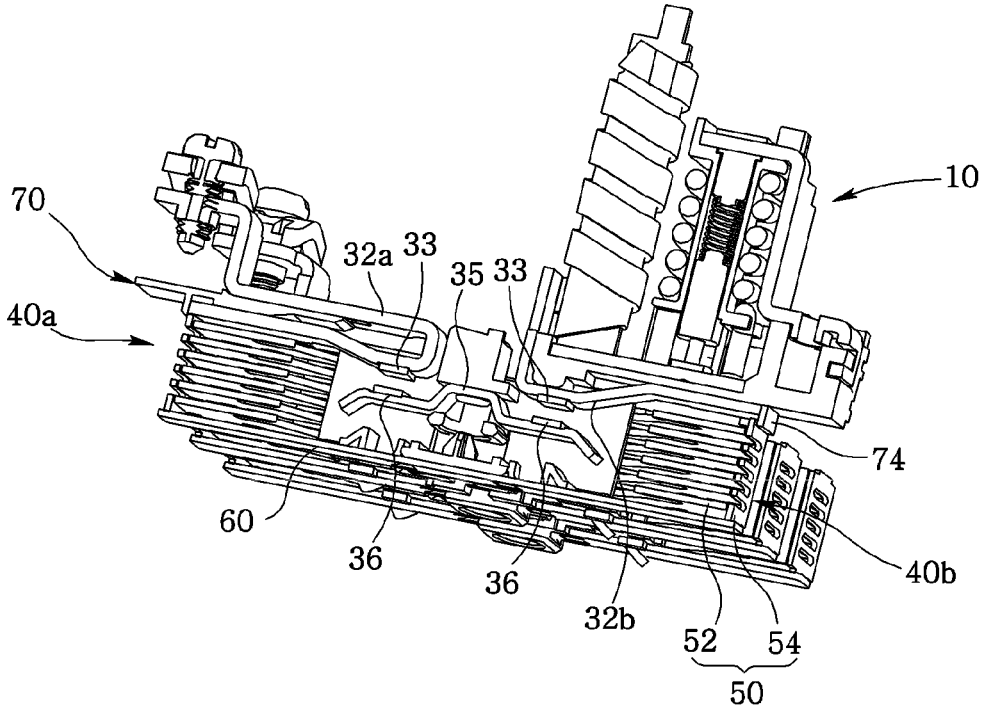
FIG. 6 is a schematic perspective view of an arc extinguishing device for manual motor starter according to an exemplary implementation.
Figure 7:
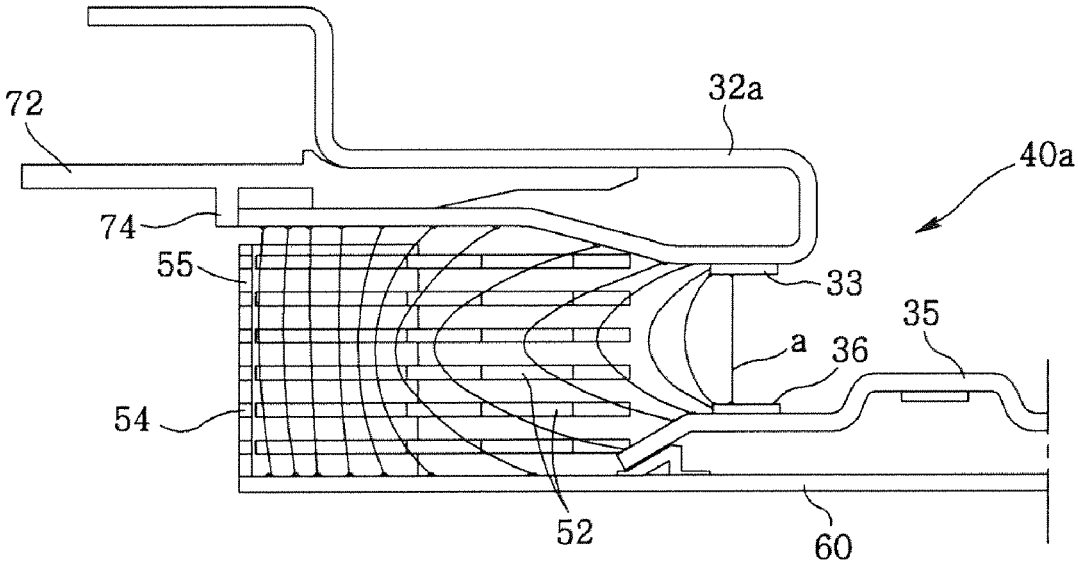
FIG. 7 is a schematic view explaining a structure of a power source-side arc extinguishing device for manual motor starter and arc extinguishing operation according to an exemplary implementation.
Figure 8:
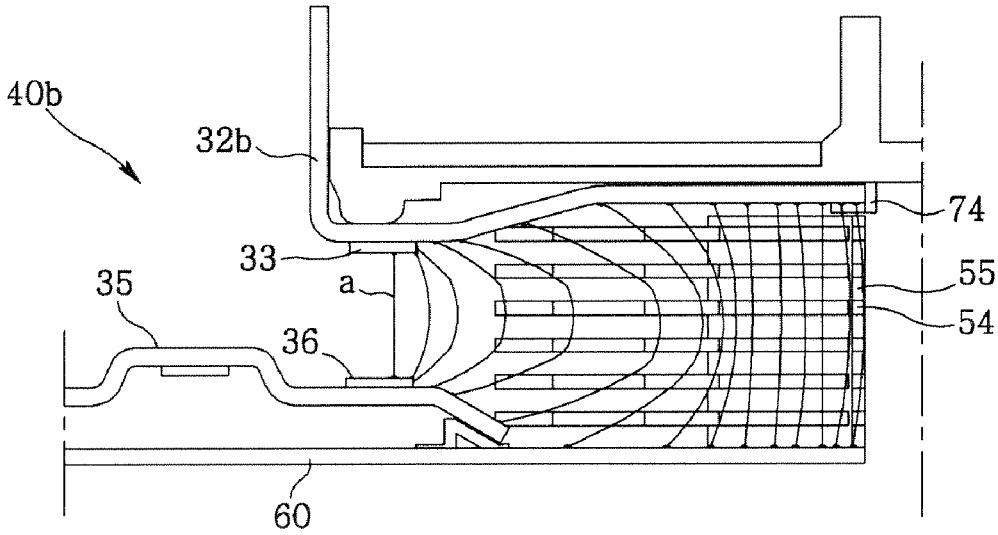
FIG. 8 is a schematic view explaining a structure of a motor-side arc extinguishing device for manual motor starter and arc extinguishing operation according to an exemplary implementation.

FIG. 6 is a schematic perspective view of an arc extinguishing device for manual motor starter according to an exemplary implementation, FIG. 7 is a schematic view explaining a structure of a power source-side arc extinguishing device for manual motor starter and arc extinguishing operation according to an exemplary implementation, and FIG. 8 is a schematic view explaining a structure of a motor-side arc extinguishing device for manual motor starter and arc extinguishing operation according to an exemplary implementation. Wherever possible, the same reference numerals will be used throughout the drawings to refer to the same or like parts having the same or like construction, operation and effects as those explained in the above conventional art.

Referring to FIG. 6, an arc extinguishing device (40) of circuit breaker for manual motor starter (MMS) has a construction having a power source-side arc extinguishing device (40*a*) and a motor-side arc extinguishing device (40*b*).

The power source-side arc extinguishing device (40*a*) and the motor-side arc extinguishing device (40*b*) are same in terms of principle and method for extinguishing arc, although there may be shape differences for some constituent parts.

An arc chamber (50) may be formed with a plurality of magnetic plates (52) and a side wall (54) in which the magnetic plates (52) are packaged. The arc chamber (50) implements an arc extinguishing operation by inducing arc (a) generated when a stationary contact (33) and a movable contact (36) are separated by the plurality of magnetic plates (52) made of a magnetic material.

A lower plate (60) may support a bottom surface of the side wall (54) and swiftly move the arc induced into the arc chamber (50) along with the stationary contact bar (32) made of conductive material.

An insulation member (70) made of insulating material is abutted onto distal ends of stationary contact bars (32*a*, 32*b*) to interrupt an arc generated between a distal end of the stationary contact bar (32) and a distal end of the lower plate (60). There is no need of insulating both distal ends of the stationary contact bar (32) and the lower plate (60) in order to prevent a residual arc from occurring from both distal ends of the stationary contact bar (32) and the lower plate (60).

In the present exemplary implementation, the distal end of the stationary contact bar (32) is abutted on the insulation member (70). Although it is not easy to abut the insulation member (70) onto the distal end of the lower plate (60) as the lower plate (60) has to be inserted into a frame of cramped space, the exemplary implementation of the present novel concept may be applied to the lower plate (60).

The coupling of the insulation member (70) to the distal ends of the stationary contact bars (32*a*, 32*b*) may avoid the occurrence of residual arc, and an interruption delay caused by the residual arc may be shortened to thereby improve the interruption performance of the circuit breaker. In addition, a circuit breaker and a motor may be protected against the fault current.

The distal ends of the stationary contact bars (32*a*, 32*b*) and the distal end of the lower plate (60) may prevent the thermal deformation caused by the residual arc to improve the arc extinguishing performance, eventually leading to an increase in short-circuit interruption capacity. In addition, damage to an extension of the conventional arc chamber during transportation may be avoided, and loss of arc interruption function caused by an inadvertent upside-down assembly of arc chambers formed at the extension may be prevented.

MODE FOR INVENTION

Referring to FIG. 7, the insulation member (70) may include a main plate (72) inserted into a 'U' shaped gap of the power source-side stationary contact bar (32*a*), and a projection (74) protrusively formed from a bottom surface of the main plate (72) to abut on a distal end of the power source-side stationary contact bar (32*a*) so as to allow the distal end of the power source-side stationary contact bar (32*a*) to be blocked from outside.

Now, referring to FIGS. 6 and 7, the power source-side stationary contact bar (32*a*) of a circuit breaker for MMS is curved in a U-shape to form an inside gap in most cases. In other words, one side of the power source-side stationary contact bar (32*a*) receives an electric power from the power source side, while the other side serving to swiftly move the arc is centrally curved in a U-shaped gap to overcome a spatial restraint. Therefore, the U-shaped gap of the power source-side stationary contact bar (32*a*) may be inserted by the main plate (72), and the distal end of the power source-side stationary contact bar (32*a*) may be simply interrupted by the projection (74) to enable a prevention of occurrence of residual arc.

Figure 9:
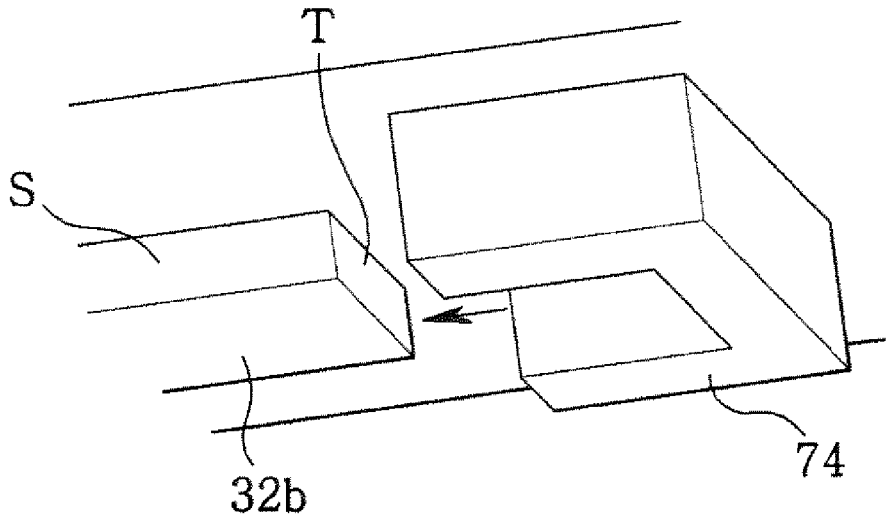
FIG. 9 is a schematic perspective view of principal parts according to an exemplary implementation in which a distal end of a motor-side stationary contact bar of FIG. 8 and an insulation member are shown.

Now, referring to FIGS. 8 and 9, the insulation member (70) may have a '⊏' shaped horizontal cross-section surface and be insertedly coupled to the distal end of motor-side stationary contact bar (32*b*). Although it is to stress that the '⊏' shaped insulation member (70) cannot be used for the power source-side stationary contact bar (32*a*), the insulation member (70) is more suitable to the motor-side stationary contact bar (32*b*).

As illustrated in FIG. 9, the distal end of the motor-side stationary contact bar (32*b*) is indicated as T, while a lateral surface is referred to as S. Therefore, the distal end (T) and lateral surface (S) of the motor-side stationary contact bar (32*b*) may abut against an inner lateral surface of the '⊏' shaped insulation member (70) to render more excellent residual current interruption capability than that of a conventional plate shape.

Figure 10:
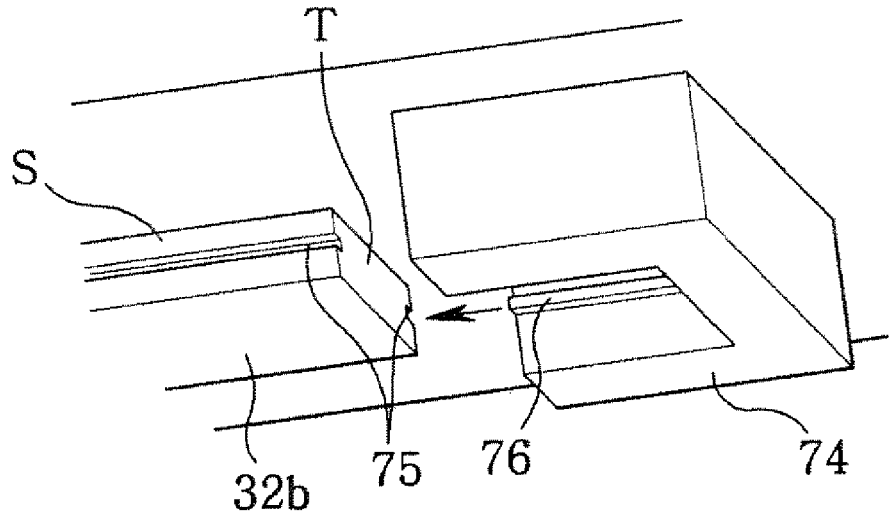
FIG. 10 is a schematic view illustrating of principal parts according to another exemplary implementation in which a distal end of a motor-side stationary contact bar of FIG. 8 and an insulation member are shown.

The distance covered by the arc along the motor-side stationary contact bar (32*b*) inside the arc chamber (50) is constant, such that the arc extinguishing performance is not decreased at all. It is simple to use because a simply configured insulation member (74) can be inserted into the distal ends of the stationary contact bars (32*a*, 32*b*). In this case, in order to simply insert the insulation member (74) into the stationary contact bars (32*a*, 32*b*) and fix the bars therein, a slit groove (75) may be formed at a lateral surface of the distal ends of the stationary contact bars (32*a*, 32*b*), as shown in FIG. 10. A rib (76) may be formed at an inner lateral surface of the insulation member (74) in order to be inserted into the slit groove (75) of the stationary contact bars (32*a*, 32*b*).

INDUSTRIAL APPLICABILITY

As noted in the foregoing, the arc extinguishing device of circuit breaker for manual motor starter is capable of preventing a residual arc generated between a distal end of a stationary contact bar and that of a lower plate to reduce an interruption time, thereby protecting a circuit breaker and a motor from being damaged by a fault current.

A thermal deformation of distal ends of stationary contact bars and a distal end of the lower plate by the residual current can be prevented to improve the arc extinguishing performance and to increase a short-circuit interruption capacity of the circuit breaker. The residual current can be removed by blocking the distal ends of the stationary contact bars from outside using easy fitting or insertion method.

Damage of an extension of the conventional arc chamber during transportation can be prevented, or loss of arc interruption performance caused by upside-down assembly of an arc chamber formed with an extension can be prevented.

While the present disclosure has been particularly shown and described with reference to exemplary implementations thereof, the general inventive concept is not limited to the above-described implementations. It will be understood by those of ordinary skill in the art that various changes and variations in form and details may be made therein without departing from the spirit and scope of the present invention as defined by the following claims.

The invention claimed is:

1. An arc extinguishing device of a circuit breaker for a manual motor starter including a detector detecting a fault current, an open/close mechanism operating in response to a detection signal of the detector, power source side and motor side stationary contact bars having stationary contacts, and movable contact bars having movable contacts each discrete from the stationary contacts by operation of the open/close mechanism, the device comprising:

an arc chamber including a plurality of magnetic plates and a side wall packaging the plurality of magnetic plates for inducing and extinguishing an arc generated when the stationary contacts and the movable contacts are separated;

a lower plate made of conductive material for supporting a lower end of the side wall;

a first insulation member coupled to a distal end of the power source side stationary contact bar for interrupting the arc generated between the distal end of the power source side stationary contact bars and a distal end of the lower plate;

a second insulation member coupled to a distal end of the motor side stationary contact bar for interrupting the arc generated between the distal end of the motor side stationary contact bar and the distal end of the lower plate, wherein the second insulation member is insertedly coupled to allow the distal end of the motor side stationary contact bar to be blocked, the second insulation member includes a '⊏' shaped cross-section and is insertedly coupled to the distal end of the motor side stationary contact bar, and a slit groove is formed on a side of the distal end of the motor side stationary contact bar, and a rib is formed on an inner side of the second insulation member so as to be insertedly coupled to the slit groove.

2. The device as claimed in claim 1, wherein the power source side stationary contact bar includes a U-shaped member, and the first insulation member comprises a main plate inserted into a 'U' shaped gap of the power source side stationary contact bar, and a projection protrusively formed from a bottom surface of the main plate to abut on the distal end of the power source side stationary contact bar so as to allow the distal end of the power source side stationary contact bar to be blocked.

* * * * *